US009198545B2

(12) United States Patent
D'Angelo

(10) Patent No.: US 9,198,545 B2
(45) Date of Patent: Dec. 1, 2015

(54) SANITARY WIPE DISPENSING APPARATUS

(71) Applicant: Nicholas D'Angelo, Marina del Rey, CA (US)

(72) Inventor: Nicholas D'Angelo, Marina del Rey, CA (US)

( * ) Notice: Subject to any disclaimer, the term of this patent is extended or adjusted under 35 U.S.C. 154(b) by 0 days.

(21) Appl. No.: 14/488,241

(22) Filed: Sep. 16, 2014

(65) Prior Publication Data

US 2015/0083743 A1 Mar. 26, 2015

Related U.S. Application Data

(60) Provisional application No. 61/881,780, filed on Sep. 24, 2013.

(51) Int. Cl.
*A47K 10/38* (2006.01)
*A47K 10/32* (2006.01)

(52) U.S. Cl.
CPC ..... *A47K 10/38* (2013.01); *A47K 2010/326* (2013.01); *A47K 2010/3266* (2013.01)

(58) Field of Classification Search
CPC ..... A47K 10/38; B65H 75/245
See application file for complete search history.

(56) References Cited

U.S. PATENT DOCUMENTS 2,555,531 A * 6/1951 Boord ..... 242/594.5
4,452,403 A * 6/1984 Arronte ..... A47K 10/40 242/596.4
6,460,799 B1 10/2002 Ryan
D506,632 S 6/2005 Holsclaw
6,945,493 B1 * 9/2005 Gottesman ..... 242/594.5
6,959,890 B1 * 11/2005 Breitinger ..... 242/592
7,195,195 B1 * 3/2007 Pullen, Jr. ..... 242/598.3
7,306,185 B1 * 12/2007 Miller ..... A47K 10/3836 242/592
7,311,221 B2 * 12/2007 Serfaty ..... 221/35
7,357,350 B1 * 4/2008 Rogers ..... 242/594.5
7,694,848 B2 * 4/2010 Petry ..... A47K 10/38 221/283
7,726,513 B2 * 6/2010 Schlaupitz et al. ..... 221/45
D655,116 S * 3/2012 Ravazi et al. ..... D6/518
8,474,652 B2 7/2013 Yaros
2002/0056785 A1 * 5/2002 Newman et al. ..... 242/588.3
2004/0075015 A1 * 4/2004 Cain et al. ..... 242/595
2004/0206651 A1 * 10/2004 Saito ..... A47K 10/3836 206/389
2007/0125902 A1 * 6/2007 Alalu et al. ..... 242/597
2007/0181594 A1 * 8/2007 Thompson ..... 221/190
2008/0001019 A1 * 1/2008 Brown ..... 242/597.8
2011/0024586 A1 * 2/2011 Brinkdopke et al. ..... 248/205.4
2012/0181297 A1 * 7/2012 Cofrancesco ..... 221/26
2012/0305589 A1 12/2012 Gerschwiler Steck et al.

* cited by examiner

*Primary Examiner* — Leslie A Nicholson, III
*Assistant Examiner* — Ayodeji Ojofeitimi
(74) *Attorney, Agent, or Firm* — Intellectual Property Law Offices of Joel Voelzke, APC

(57) ABSTRACT

A dispenser for personal sanitary wipes is suspended below a toilet paper roll by hooking into one or both sides of the core tube of a toilet paper roll at the same time that the toilet paper roll is mounted on a toilet paper spindle. In order to reduce friction as the toilet paper roll rotates, the dispenser may have wheels or rollers mounted on arm(s) that extend into the core tube.

20 Claims, 5 Drawing Sheets

FIG. 1
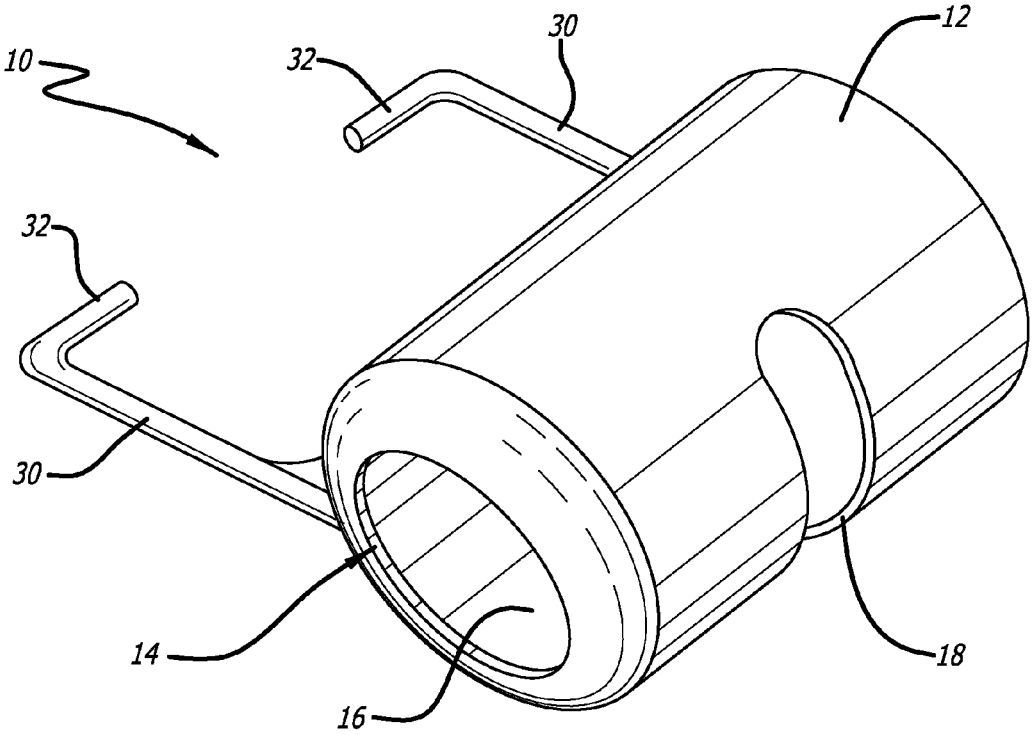
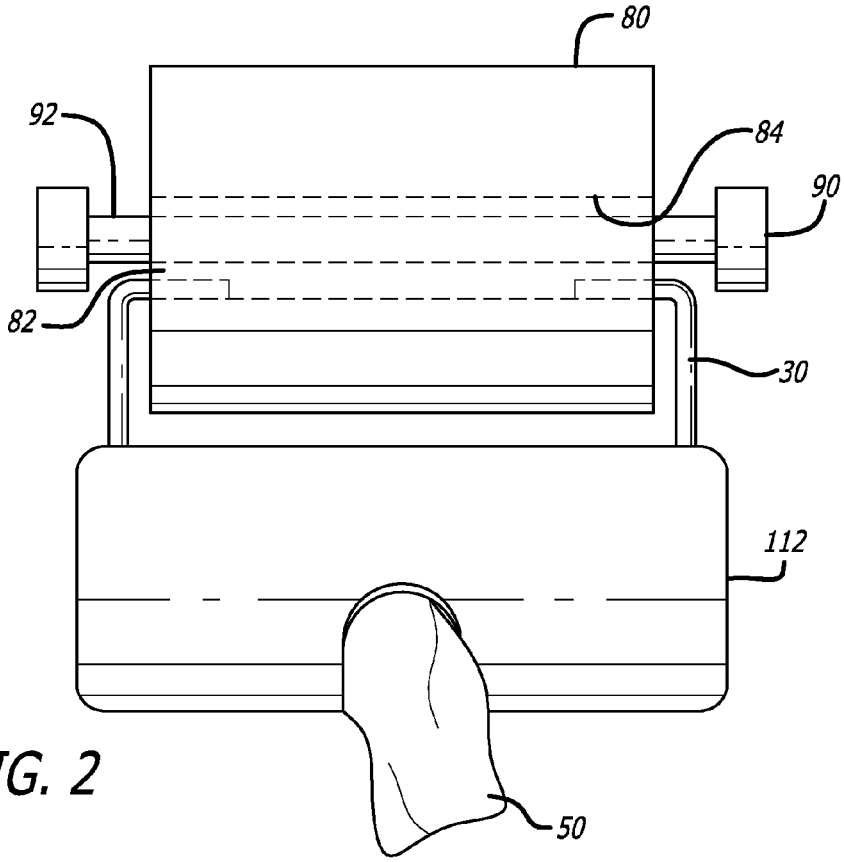
FIG. 2

SANITARY WIPE DISPENSING APPARATUS

CROSS-REFERENCE TO RELATED APPLICATIONS

This application claims priority from U.S. provisional patent application Ser. No. 61/881,780 filed Sep. 24, 2013.

FIELD OF THE INVENTION

This invention relates to the field of sanitary wipes. More particularly, this invention relates to the field of dispensers for personal sanitary wipes.

DESCRIPTION OF RELATED ART

Sanitary wipes have become a much more visible personal hygiene option over the last decade as an additional form of personal cleansing, household cleaning, anti-bacterial defense, and other uses. Such wipes are sometimes comprised of air-laid paper where the fibers are carried and formed into the structure of paper by air. These wipes are typically pre-moistened with any of a number of liquids, softeners, lotions, medications, anti-bacterial solutions, etc. to be used for personal hygienic purposes. Such wipes are accordingly sometimes referred to as "moist towelettes" or "wet wipes."

Conventionally, these types of sanitary wipes are housed in a container which allows individual wipes to be serially dispensed while retaining moisture within the pack, whether in a soft plastic pack or in a hard plastic container that allows for retrieval of one wipe per pull. Specifically, such wipes in the aforementioned containers are increasingly being used to complement standard dry toilet paper in a bathroom setting in the form of flushable personal sanitary wipes. In a bathroom setting, however, there is limited space and therefore there are limited options where conventional sanitary wipe containers can be placed. Countertops, shelves, and the bathroom floor are the favored locations for such containers housing sanitary wipes for bathroom use, yet none of those placements are convenient to the wipe user who is restricted to his location sitting on the toilet.

This inconvenience is one reason why personal sanitary wipes are not used in the bathroom setting more often despite the fact that the addition of a sanitary wipe in the bathroom cleaning process allows for more thorough cleansing. If a more conveniently located wipe dispensing option were offered or available, the use of sanitary wipes during bathroom usage could become more commonplace.

OBJECTS OF THE INVENTION

It is an object of the invention to provide a personal sanitary wipe dispenser that places the wipes within easy reach, but with minimal effort and/or hardware required for mounting the dispenser.

SUMMARY OF THE INVENTION

The sanitary wipe dispenser of the present invention addresses this need by attaching to the inside of the core tube of an existing toilet paper roll. This convenient placement and simplicity of design allows for the dispenser to quickly engage and disengage the toilet paper roll without disrupting the retrieval of dry toilet paper. No additional hardware needs to be installed, and replacement of both the dry toilet paper roll and the sanitary wipe apparatus is easy in that each can be quickly replaced as needed. In addition to the convenience of engagement and retrieval, the sanitary wipe dispenser will be within arms-reach of the toilet user and only inches away from the dry toilet paper. The dispenser can hold different types of wipes for simple and convenient dispensing. The invention provides a simple and efficient mounting and dispensing apparatus for personal sanitary wipes. By placing the sanitary wipes in close proximity to the dry toilet paper, a much cleaner and more thorough cleansing process becomes possible after using the toilet.

The dispenser includes a housing having an internal storage chamber adapted to contain a supply of sanitary wipes internally so that the housing can operate as its own dispenser of sequentially dispensed wipes. The device features a novel means to engage a conventional toilet paper core tube as the toilet paper roll is mounted on a standard toilet paper holder.

In one embodiment the apparatus has two rods or support arms made of plastic, steel, or other flexible material, extending from the side walls or the roof of the hollow chamber housing the wipes, and engagement arms that extend into the toilet paper roll's core tube using either short prongs at angles near or at 90 degrees or longer interlocking prongs at angles near or at 90 degrees that hook together inside the inner cardboard tube of the toilet paper roll. The main chamber housing the wipes will be hollow and can be made of plastic or a similar composite, and can be have a cylindrical, oval, or rectangular shape, or some variation on those or other shapes.

In another embodiment the apparatus has only a single arm, the single arm extending all the way through the toilet paper core tube and having a downward projection that acts as a retainer that helps prevent the arm from inadvertently slipping out from the toilet paper roll. The arm(s) may have rotating means such as rotating rods or wheels which roll on the inner surface of the toilet paper core tube, thus reducing friction when paper is being withdrawn from the toilet paper roll.

Wipes are held within the chamber in a manner that they can be retrieved either through an aperture found at the very bottom of the chamber or at varied different angles in relation to the bottom-most portion. The dispensing aperture can either span the length of the housing chamber, a length shorter than the length of the housing chamber, or can be an ovular or circular aperture through which the wipes can be pulled. The wipes within the housing chamber are situated and stacked sequentially so that when the bottom-most wipe is pulled through the dispensing aperture, it will pull away cleanly, leaving the next bottom-most wipe in its place ready for retrieval. The device allows for the dual positioning of both dry toilet paper and sanitary wipes so that a toilet user has equally convenient access to both allowing a more thorough cleansing experience. The dry tissue and wet wipes are not mutually exclusive and can be used completely separately or as a complement to each other. The hanging apparatus will not impede the easy retrieval of dry toilet paper, and as an added bonus due to slight additional friction created by hanging from the roll, the use of the apparatus in combination with the dry tissue roll prevents inconvenient free-spools in which unwanted lengthy sections of dry tissue hang from the roll due to lack of friction.

The arms extending from the hollow chamber are bendable so that they can potentially hook onto or into other pre-existing bathroom, home or car fixtures so that the apparatus can hang in other places allowing convenient dispensing of wipes in a variety of locations, i.e. if the arms can hook on to a pre-existing fixture, they can also dispense from that location. The invention offers simplicity and efficiency of one solid structure whose engagement to a toilet paper roll is easily understood, and there is no additional hardware or installation necessary as is the case with various dispenser designs of the prior art.

In one aspect therefore, the invention is of a dispenser for personal sanitary wipes, the dispenser having a hollow housing, an internal storage chamber for holding the wipes, a first opening in the housing for loading wipes into the storage chamber, and a second opening for dispensing wipes individually and serially to the user. At least one generally vertical support arm extends upward from the housing, and a generally horizontal engagement arm extends from the support arm and into the core tube of a toilet paper roll. The dispenser thus hangs from the toilet paper roll. In one embodiment the dispenser has two pair of such support and engagement arms, the arms are resilient enough to be opened wide enough to allow the horizontal portions to be slipped over a toilet paper roll, and when the arms are released they spring back such that the horizontal portions engage the toilet paper core tube. In this way the dispenser attaches quickly and easily to an existing toilet paper roll as that roll is mounted on a standard household toilet paper dispenser.

In another embodiment the dispenser has one arm, with the arm having a horizontally extending portion that extends all the way through the toilet paper roll. The arm may have a downwardly projecting portion or some other keeper to inhibit the arm and thus the dispenser from inadvertently slipping out of the toilet paper roll and falling to the ground.

Whether the dispenser has one or two arms, the horizontally extending portions of the arm(s) may have friction reducing features on them such as rounded nubs, cylindrical rollers, wheels, or captive balls in sockets.

The housing may be configured to accept differently packaged wipes including a stack of wipes or a roll of wipes. The opening through which the wipes are dispensed can have a cover that is either removable or hinged.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

BRIEF DESCRIPTION OF THE DRAWINGS

FIG. 1 is an oblique view of a dispenser according to a first embodiment of the invention.

FIG. 2 is a front elevation view of the dispenser of FIG. 1, depicting the dispenser hanging from a standard toilet paper roll and its holder.

DETAILED DESCRIPTION OF THE PREFERRED EMBODIMENTS

Figure 3:
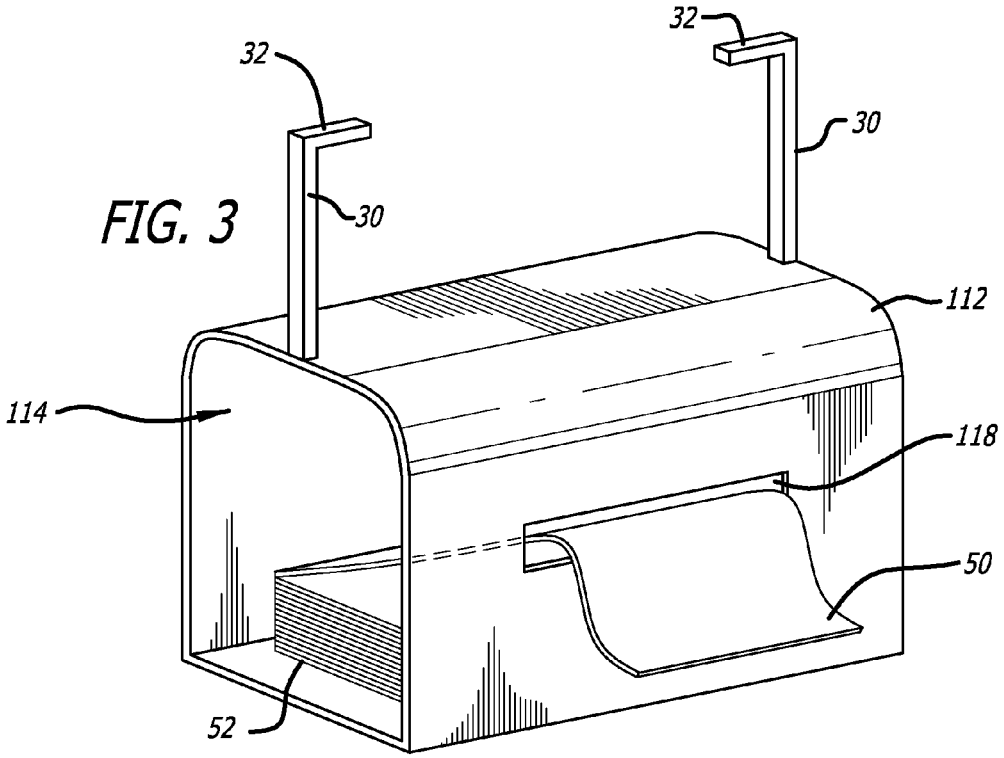
FIG. 3 is an oblique view of a dispenser according to a second embodiment.

FIG. 1 is an oblique view of a dispenser according to a first embodiment of the invention. Dispenser 10 includes a hollow housing 12 having an opening 14 into storage cavity 16 into which a pack of wet wipes is loaded and held within cavity 16. Individual ones of the wet wipes are dispensed serially through a second opening 18. Two generally vertically extending support arms 30 extend upward from housing 12. Each support arm 30 has a generally horizontally extending engagement arm 32 such that the two engagement arms 32 point toward and face each other. Support arms 30 may be made of a resilient material such as plastic, steel, plastic with spring steel embedded therein, or other resiliently bendable materials, such that the upper ends of arms 30 including engagement arms 32 may be bent apart elastically in order to slip engagement arms 32 over the ends of a standard toilet paper roll, and upon release the engagement arms 32 spring back inwardly to engage the axial hole or central cavity through the toilet paper roll including the core tube. As used herein including in the appended claims, the term "core tube" encompasses both the cardboard tube that lies in the center of a conventional toilet paper roll, as well as the innermost layer of toilet paper itself in a so-called "tubeless" type toilet paper roll that has been recently introduced. Thus, as used herein all rolls of toilet paper having axial holes therethrough have core tubes regardless of whether the roll has a cardboard tube.

Second opening 18 could be oriented either circumferentially as shown, or longitudinally/horizontally as shown in FIG. 3, or some other orientation.

Each of the horizontal arms 32 could be provided with one of the friction reducing means disclosed herein, including the cylindrical roller, the wheels, or the rounded nubs or protrusions shown in FIGS. 4 and 7-10 and described in connection with those figures, or captive balls in sockets similar to computer track balls.

Figure 4:
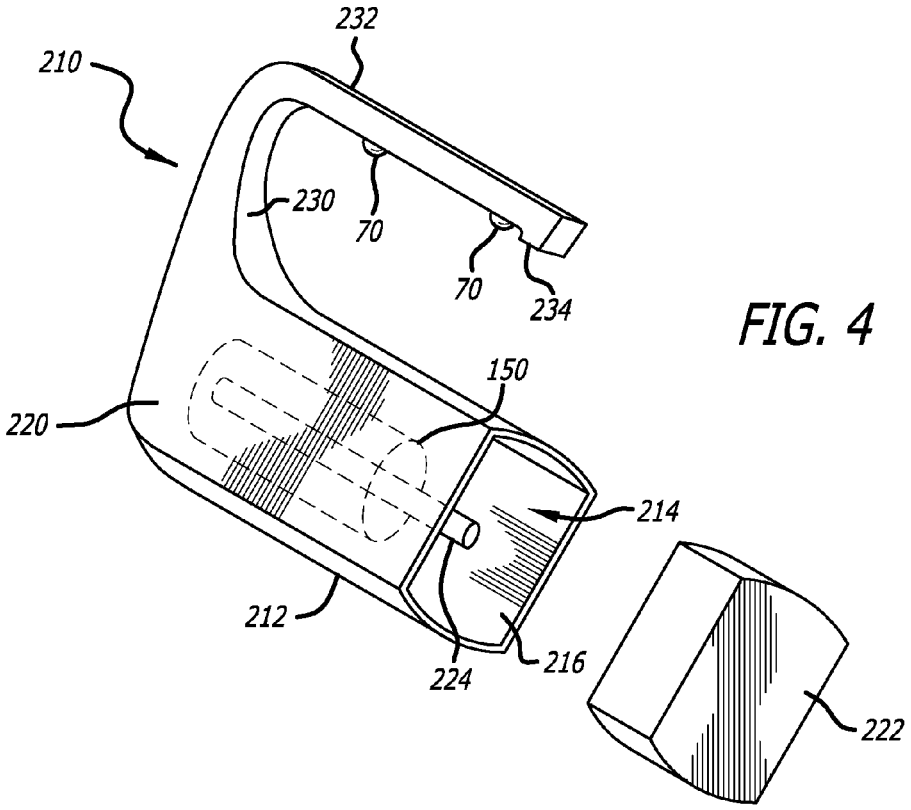
FIG. 4 is an oblique view of a third embodiment.
Figure 5:
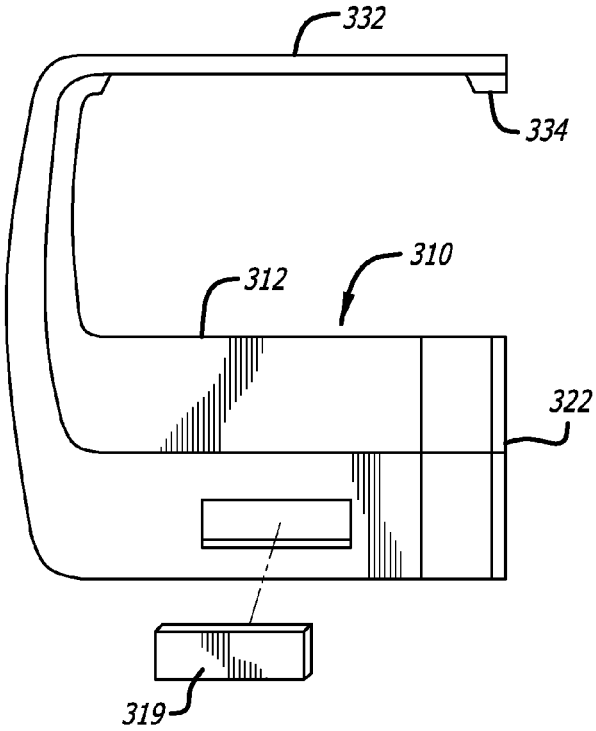
FIG. 5 is a front elevation view of a fourth embodiment.

Additionally, housing 12 could be provided with a removable lid to cover loading opening 14 similar to lid 222 in FIG. 4, and/or with a removable lid to cover dispensing opening 18 similar to lid 319 in FIG. 5. Alternatively, one or both of those lids could be hinged. A hinged lid covering dispensing opening 18 could be lightly spring biased toward the closed position in order to keep that opening mostly closed and thus to minimize loss of moisture from the wet wipes, while also allowing wipes to be dispensed on demand.

FIG. 2 is a front elevation view of the dispenser of FIG. 1, depicting the dispenser hanging from a standard toilet paper roll and its holder. In this embodiment the dispensing opening is oriented longitudinally rather than circumferentially as in FIG. 1. The figure depicts how a dispenser of the invention can be mounted to an existing toilet paper roll 80 which is itself mounted on a standard toilet paper holder 90 including a standard toilet paper spindle 92 which extends through the core tube 84 which defines the walls of the axial hole 82 through toilet paper roll 80. Support arms 30 and engagement arms 32 are dimensioned so that the dispenser can engage core tube 84 at the same time that spindle 92 extends through core tube 84, with housing 112 hanging below toilet paper roll 80 without interfering with its rotation. As seen in the figure, engagement arms 32 are sufficiently narrow so that they can extend into and engage the toilet paper core tube 84 at the same time as core tube 84 is also occupied by spindle 92 which extends through core tube 84 to hold toilet paper roll 80. The width of the cross section of engagement arm 32, plus the width of the cross section (the diameter) of spindle 92, is less than the inner diameter of core tube 84. Dispenser 10 hands downwardly and freely from core tube 84 at the same as toilet paper roll 80 is mounted upon spindle 92.

In order to accomplish these goals with a standard toilet paper roll and a variety of toilet paper spindles: (a) support arms 30 are at least 4 cm long, and are preferably 5-10 cm long; (b) the tips of engagement arms 32 are preferably less than 9 cm long when engagement arms 32 are unbent, and support arms 30 can be easily and resiliently bent apart such that the tips of engagement arms 32 are at least 11 cm apart and they spring back toward each other when engagement arms 32 are released; (c) the engagement arms 32 are preferably less than 2 cm wide, and more preferably less that 1.5 cm wide, along at least a 10 cm long length of the engagement arm in a single engagement arm embodiment; and (d) support arms 30 are at least 11 cm apart, and preferably 12-17 cm apart.

All that is necessary in order to mount wet wipe dispenser 112 for easy use is to bend apart the ends of support arms 30, slip the engagement arms 32 over a standard toilet paper roll 80 mounted on its own dispenser, then let the arms spring back together such that those arms into the core tube 84 of the toilet paper roll. The bottom of the engagement arms rest against the bottom inner wall of the central cavity in the toilet paper roll, suspending the dispenser and the wipes from the roll. Similarly, all that is necessary to remove dispenser 112 is to bend apart support arms 30 until engagement arms 32 no longer extend into core tube 84, and then pull the dispenser away. In this way a user can install or remove dispenser 112 in seconds.

FIG. 3 is an oblique view of a dispenser according to a second embodiment. Stack 52 of wet wipes 50 can be seen. Stack 52 of wet wipes is loaded into housing 112 through loading opening 114, and the first wet wipe 50 is fed through the dispensing opening 118. Thereafter individual wipes 50 are serially dispensed to the user as a user pulls on them.

FIG. 4 is an oblique view of a third embodiment, with the dispensing opening 118 omitted for clarity of illustration. The dispensing opening 118 could be placed in virtually any location on the housing and be aligned in any orientation. As with the previous embodiments dispenser 210 has a housing 212 having a wet wipe loading opening 214, a cavity 216 which receives and stores the wet wipes, a dispensing opening through which the wipes are dispensed, and optionally a removable lid 222 or a hinged lid. The dispense opening can be located on the bottom, sides, or even on the top of the housing.

In this embodiment the dispenser 210 employs only a single engagement arm 232 to suspend the housing 212 below a toilet paper roll 80, engagement arm 232 and housing 212 being connected by generally vertically extending support arm 230. The single engagement arm 232 preferably extends all the way through the toilet paper core tube, and is preferably 12-18 cm long for doing so. A downward projection 234 extends downwardly from the distal end of engagement arm 232 to abut up against the end of the toilet paper roll 80 and thus inhibit engagement arm 232 from inadvertently coming out of core tube 84. Other engagement means could be provided to inhibit withdrawal of engagement arm 232 from core tube 84 including features which snap or screw into or onto the end of engagement arm 232.

Additionally, in this embodiment the wet wipes come in a roll 150 of wet wipes, so housing 212 has a rod 224 affixed to and projecting from rear wall 220 of housing 212. Rod 224 functions as a spindle to hold roll 150 of wet wipes and allow that roll to rotate as the wipes are withdrawn by the user.

As shown, engagement arms 232 have two rounded nubs 70 that rest against the inside of core tube 84 to help reduce friction as toilet paper roll 80 rotates.

As discussed above with respect to FIG. 1, dispenser 210 could have one or two engagement arms, could have removable or hinged lids for each opening in housing 212, could have any one of a variety of friction reducing means on its engagement arm(s) 232, and could have any one of a variety of dispensing openings and dispensing opening covers in a variety of locations.

FIG. 5 is a front elevation view of a fourth embodiment. As with the previous embodiments, dispenser 310 includes a hollowing housing 312, openings for loading and dispensing the wipes, a first lid 322 for covering the loading opening, a second lid 319 for covering the dispense opening, and a generally horizontally extending engagement arm 332. Downward projection 334 acts as a keeper to inhibit inadvertent withdrawal of engagement arm 332 from the toilet paper roll 80.

As discussed above with respect to FIG. 1, dispenser 310 could have one or two engagement arms, could have removable or hinged lids for each opening in housing 312, and could have any one of a variety of friction reducing means on its engagement arm(s) 332. Housing 312 could be configured to accommodate either a stack or a roll of wet wipes.

Figure 6:
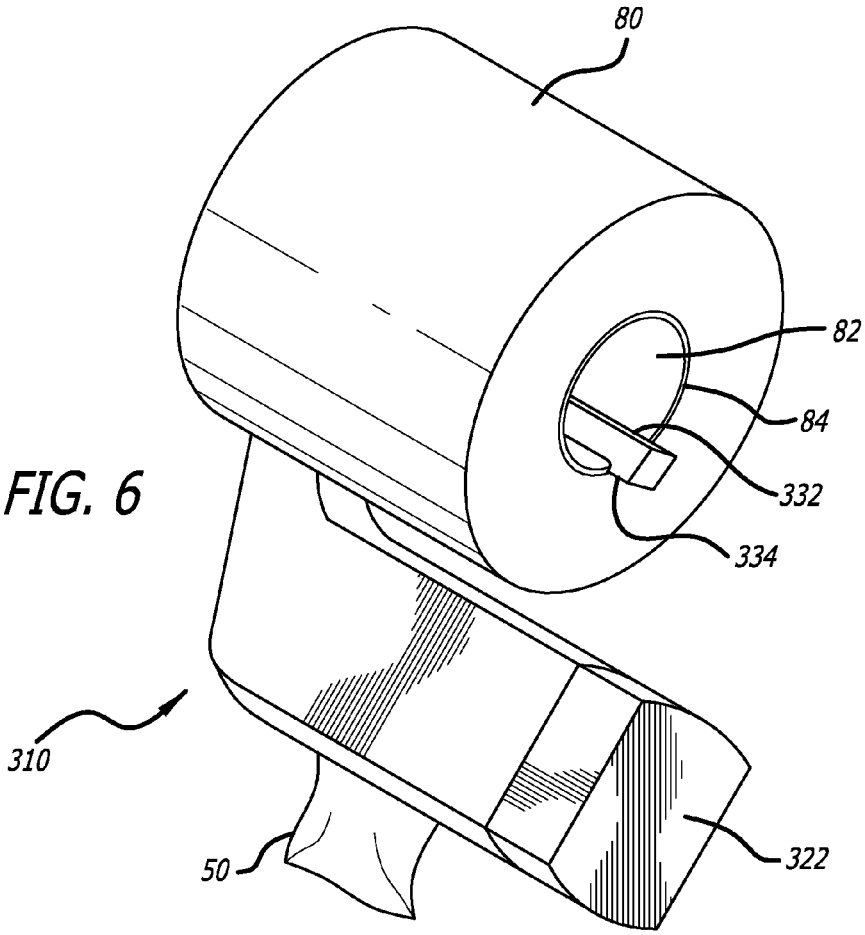
FIG. 6 is an oblique view of the dispenser of FIG. 5, depicting the dispenser hanging from a toilet paper roll.

FIG. 6 is an oblique view of the dispenser of FIG. 5, depicting dispenser 310 hanging from a toilet paper roll 80. Engagement arm 332 extends through hole 82 in core tube 84, and downward projection 334 helps to prevent engagement arm 332 from accidentally coming out of core tube 84 and thus to help prevent dispenser 310 from accidentally falling to the floor.

Figure 7:
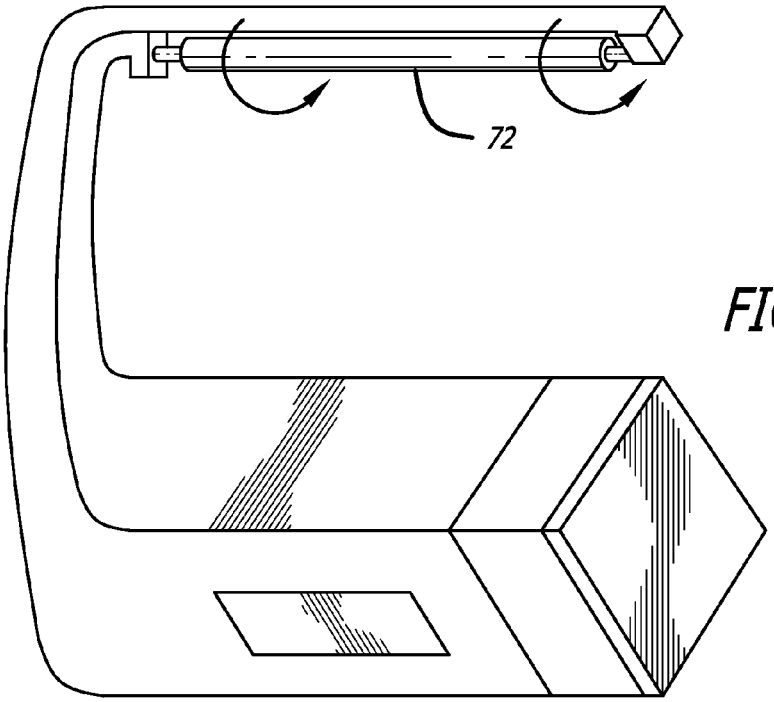
FIG. 7 is an oblique view of a fifth embodiment.

FIG. 7 is an oblique view of a fifth embodiment. In this embodiment a freely rotating cylindrical roller 72 is provided on the underside of engagement arm 332. Roller 72 rolls against the inner surface of toilet paper roll 80 including its core tube 84, thus reducing friction as the user withdraws toilet paper and the toilet paper 80 rotates.

Figure 8:
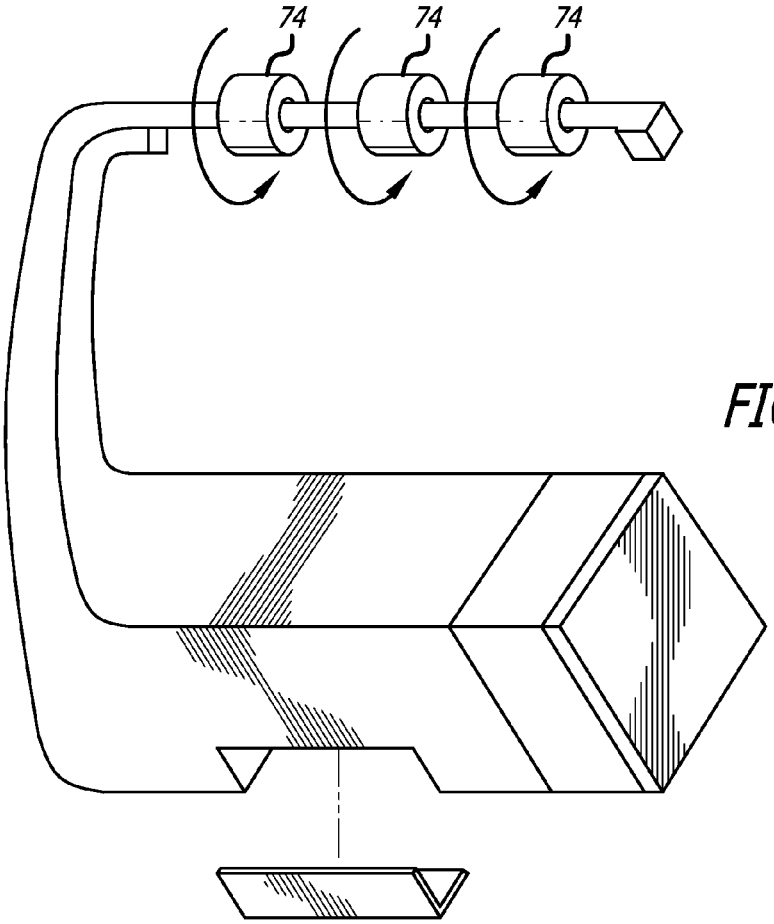
FIG. 8 is an oblique view of a sixth embodiment.

FIG. 8 is an oblique view of a sixth embodiment, employing two or more freely rotating wheels 74 on engagement arm 332. Wheels 74 roll against the inner walls of toilet paper roll 80 including its core tube 84, thus reducing friction as the user withdraws toilet paper and the toilet paper 80 rotates.

Figure 9:
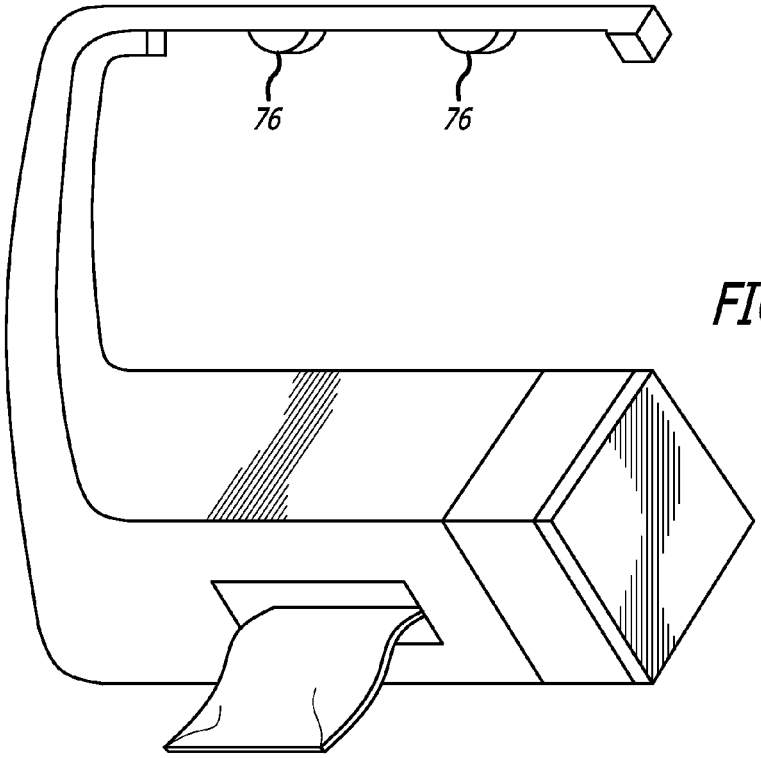
FIG. 9 is an oblique view of a seventh embodiment.

FIG. 9 is an oblique view of a seventh embodiment employing stationary smooth rounded protrusions 76 on the underside of engagement arm in order to reduce friction with core tube 84.

Figure 10:
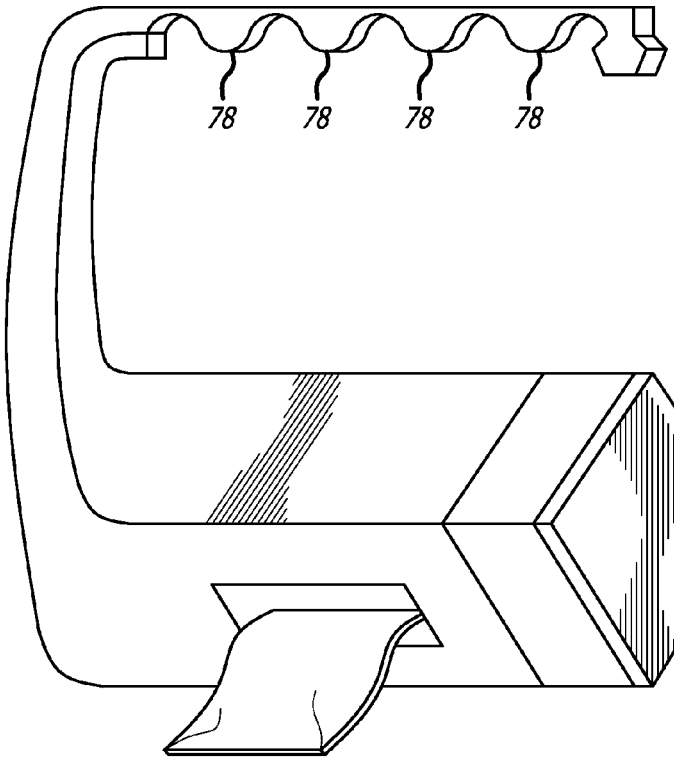
FIG. 10 is an oblique view of an eighth embodiment.

FIG. 10 is an oblique view of an eighth embodiment employing a number of evenly distributed round protrusions 78 on the underside of engagement arm in order to reduce friction with core tube 84.

The invention is not limited to use with a wet wipe dispenser. Rather, the invention including the engagement arms disclosed herein could be used to hang any one of a variety of different objects and apparati from a toilet paper core tube including but not limited to: an air freshener; a hand sanitizer dispenser; and a tray or a pocket for holding such articles as a music player, a small radio, or a cellular telephone.

It will be understood that the terms "generally," "approximately," "about," "substantially," and similar terms as used within the specification and the claims herein allow for a certain amount of variation from any exact dimensions, measurements, and arrangements, and that those terms should be understood within the context of the description and operation of the invention as disclosed herein.

All features disclosed in the specification, including the claims, abstract, and drawings, and all the steps in any method or process disclosed, may be combined in any combination, except combinations where at least some of such features and/or steps are mutually exclusive. For example, all embodiments may include rollers, wheels, captive balls, rounded nubs, or other friction reducing features on the engagement arm(s); all embodiments may include removable lids or hinged lids for the loading opening and the dispensing opening; all embodiments may be adapted to receive stacks, rolls, or other configurations of wet wipes and then dispense them; all embodiments may have dispensing openings on the top, bottom, or sides of the dispenser housing, and the housing could generally be of any shape. Furthermore, each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A dispenser for personal sanitary wipes comprising:

a hollow housing, the housing having:

an internal storage chamber for holding a plurality of personal sanitary wipes;

a first opening in the housing for loading said plurality of personal sanitary wipes into the internal storage chamber;

a second opening in the housing for allowing said personal sanitary wipes to be serially dispensed from the internal storage chamber to a user; and a first generally horizontally extending engagement arm, the engagement arm adapted to engage a core tube of a toilet paper roll thereby suspending the dispenser from the toilet paper core tube, the engagement arm being sufficiently narrow so as to extend into and engage the toilet paper core tube at the same time as the toilet paper core tube is also occupied by a standard toilet paper spindle extending through the core tube to hold the toilet paper roll, the sanitary wipe dispenser thereby hanging downwardly and freely from the toilet paper core tube at the same time as the toilet paper roll is mounted upon the toilet paper spindle.

2. The dispenser of claim 1 further comprising:

a second generally horizontally extending engagement arm, the two engagement arms extending inwardly toward each other, the two engagement arms engaging opposite ends of the toilet paper core tube.

3. The dispenser of claim 2 wherein the two engagement arms are resilient such that the two engagement arms can be resiliently bent away from each other sufficiently far that their ends can be inserted into the opposite ends of the toilet paper core tube, whereupon when the two arms are released they spring back toward each other and are engagingly held by the toilet paper core tube.

4. The dispenser of claim 1 wherein the engagement arm is long enough to extend all the way through the toilet paper core tube.

5. The dispenser of claim 4 wherein the engagement arm has a length of between 12 and 18 cm.

6. The dispenser of claim 1 further comprising a retaining portion projecting downwardly from a distal end of the engagement arm, the retaining portion abutting against an end of the toilet paper roll to hold the engagement arm within the core tube when the dispenser hangs freely therefrom.

7. The dispenser of claim 1 wherein the toilet paper core tube comprises an inner layer of toilet paper in a roll of toilet paper that has no cardboard tube therein.

8. The dispenser of claim 1 further comprising at least one rotating structure mounted to the engagement arm, the rotating structure rotating freely relative to the engagement arm and rolling along an inner wall of the toilet paper core tube when the toilet paper roll is rotated in order to reduce friction between the engagement arm and the toilet paper roll as the toilet paper roll rotates.

9. The dispenser of claim 8 wherein the rotating structure comprises a cylindrical roller rotatably mounted to the engagement arm.

10. The dispenser of claim 8 wherein the rotating structure comprises a plurality of wheels.

11. The dispenser of claim 8 wherein the rotating structure comprises a plurality of balls held captive in respective sockets.

12. The dispenser of claim 1 further comprising a chamber cover for covering said first opening.

13. The dispenser of claim 1 further comprising a hinged cover for selectively covering and opening said second opening, allowing a user to cover the second opening and thus reduce evaporation from the personal sanitary wipes when the dispenser is not being used.

14. The dispenser of claim 1 further comprising a rod extending within the internal storage chamber, the rod defining a spindle upon which a roll of said personal sanitary wipes rotates as said wipes are being dispensed through the second opening.

15. The dispenser of claim 1 wherein the engagement arm has a maximum cross section dimension of 2 cm along at least a 10 cm long segment of the engagement arm.

16. The dispenser of claim 1 wherein, along a segment of the engagement arm that is at least 10 cm long, said engagement arm segment is separated from the housing by at least 4 cm.

17. A dispenser for personal sanitary wipes comprising:

a hollow housing, the housing having an internal storage space for holding a plurality of wipes;

an opening in the housing adapted to allow a user to serially withdraw individual ones of the wipes from the housing;

an arm adapted to extend from a first end of a standard toilet paper roll through a core tube of the toilet paper roll to a second and opposite end thereof at the same time that the core tube is also occupied by a toilet paper spindle such that the toilet paper roll is suspended by the toilet paper spindle and the dispenser is simultaneously suspended by the arm from the toilet paper core tube; and a keeper at the second side of the toilet paper roll that inhibits withdrawal of the arm from the core tube.

18. The dispenser of claim 17 wherein the keeper comprises a projection from an end of the arm, the projection extending in a downward direction to abut against the second end of the toilet paper roll and thereby inhibit said withdrawal of the arm.

19. The dispenser of claim 17 wherein the arm includes a rotating member, the rotating member rolling against an inner surface of the toilet paper core tube in order to reduce friction as a user unrolls toilet paper from the toilet paper roll.

20. A dispenser for hanging a plurality of wipes from a toilet paper roll comprising:

a structure for holding the wipes; and a means for engaging a bottom inner wall of a central cavity in a toilet paper roll, the means being narrow enough to extend into the toilet paper roll and engage said bottom inner wall of the central cavity at the same time as the central cavity is also occupied by a toilet paper dispenser spindle extending through the central cavity, such that the structure may be suspended from and hang downwardly from said toilet paper roll central cavity bottom inner wall at the same time as the toilet paper roll is mounted to the toilet paper dispenser spindle.

* * * * *